US006227416B1

(12) United States Patent
Lee

(10) Patent No.: US 6,227,416 B1
(45) Date of Patent: May 8, 2001

(54) DEPRESSABLE CAP OF A BOTTLE FOR EJECTING CONTENTS

(75) Inventor: Yu-Kang Lee, Taipei (TW)

(73) Assignee: Jung Kuo Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/524,602

(22) Filed: Mar. 14, 2000

(51) Int. Cl.[7] ..... B67D 5/42
(52) U.S. Cl. ..... 222/321.7; 222/321.9
(58) Field of Search ..... 222/320, 321.1, 222/321.7, 321.9, 568

(56) References Cited

U.S. PATENT DOCUMENTS 358,811 * 3/1887 Hallowell ..... 222/568 X
2,038,778 * 4/1936 Williams ..... 222/321.9 X
2,519,640 * 8/1950 Echols, Sr. et al. ..... 222/321
3,720,376 * 3/1973 Morane et al. ..... 222/308
5,044,803 * 9/1991 Kurosawa et al. ..... 222/570 X
5,248,071 * 9/1993 Ray ..... 222/568

* cited by examiner

*Primary Examiner*—Kenneth Bomberg
(74) *Attorney, Agent, or Firm*—Rosenberg, Klein & Lee

(57) ABSTRACT

A depressable cap of a bottle for ejecting contents of the bottle is provided. The depressable cap comprises a depressable member, an exit tube and a guiding tube. The depressable member is fitted onto an upper opening of the bottle, and has a passage consisting a first threaded end portion, and a second threaded end portion. The first threaded end portion is perpendicular to, and in open communication with the second threaded end portion. The exit tube has a threaded end portion screwed into the first threaded end portion. The guiding tube has a threaded end portion screwed into the second threaded end portion of the depressable member.

1 Claim, 4 Drawing Sheets

DEPRESSABLE CAP OF A BOTTLE FOR EJECTING CONTENTS

BACKGROUND OF THE INVENTION

The present invention relates to bottles having caps depressable for ejecting the contents. The depressable caps are mostly made of plastics or metal. The plastic depressable caps can be with low cost, but they have a disadvantage that they do not look very worthy and cannot add value to the bottles, which they are fitted to.

The metallic depressable caps have finer quality, and look worthier than the plastic ones. However, they have higher manufacturing cost because the metallic material is more expensive, and more difficult to process. And, the metallic caps do not look soft and pleasant to touch.

SUMMARY OF THE INVENTION

It is a main object of the present invention to provide a depressable cap for a bottle which can overcome the above said disadvantages of the plastic ones and the metallic ones.

The depressable cap comprises:

a depressable member; the depressable member is fitted to an upper end opening of the bottle, and has a passage therein; the passage consists of two threaded end portions which are perpendicular to, and in open communication with each other;

an exit tube; the exit tube has a threaded end portion screwed into one of the depressable member threaded end portion;

a guiding tube; the guiding tube also has a threaded end portion screwed into the other one of the depressable member threaded end portion.

The depressable member is made of nonmetallic materials so it has relatively low cost. And, the nonmetallic depressable member can be made to have various colors in order to match the bottle.

BRIEF DESCRIPTION OF THE DRAWINGS

The present invention will be better understood by reference to the accompanying drawings, wherein.

DESCRIPTION OF THE PREFERRED EMBODIMENT

Figure 1:
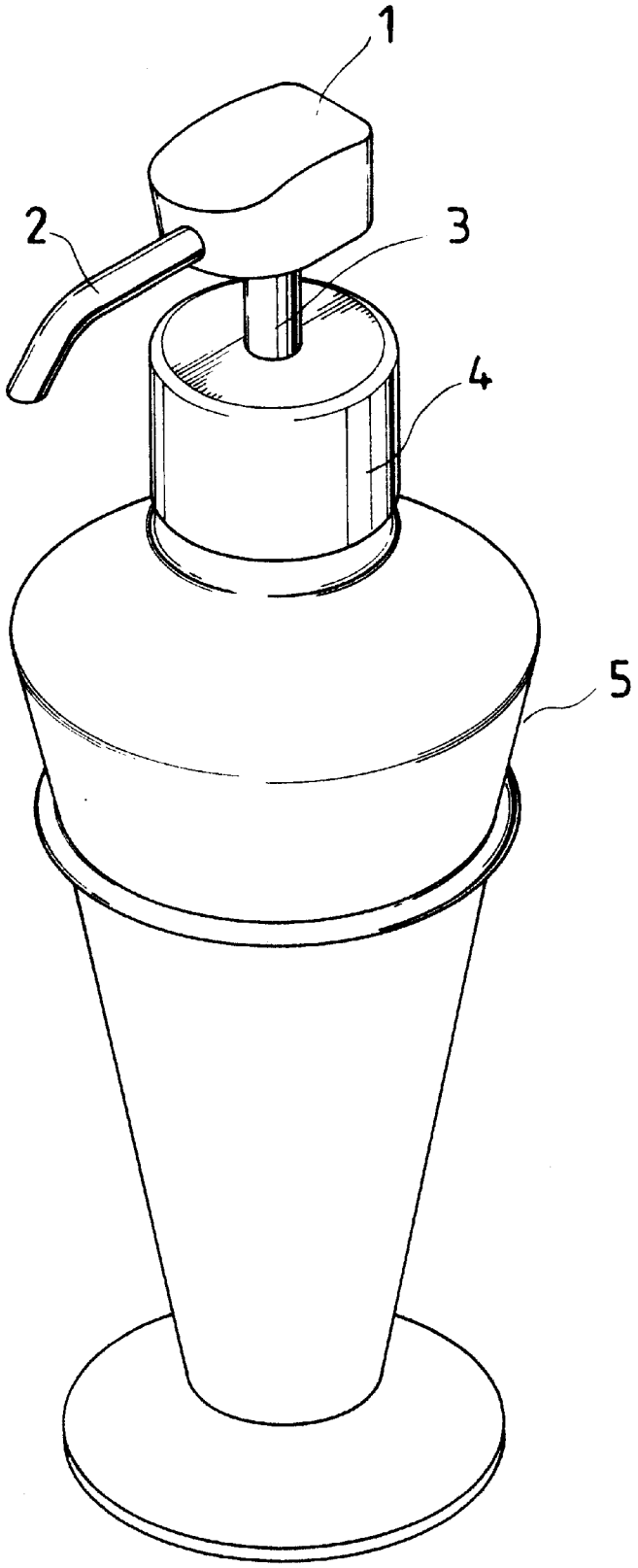
FIG. 1 is a perspective view of a bottle with the depressable cap of the present invention.
Figure 2:
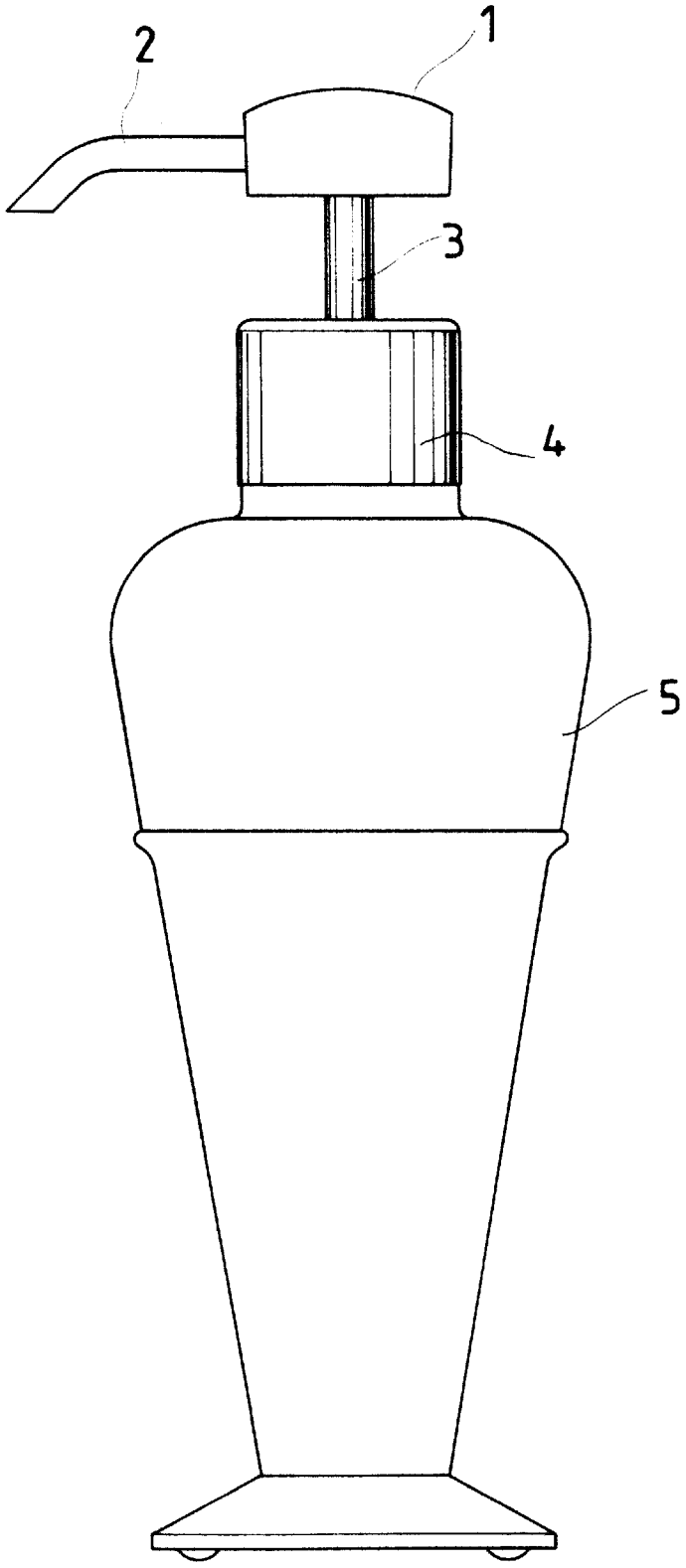
FIG. 2 is a side view of the bottle with the depressable cap of the present invention.

Referring to FIGS. 1 and 2, a depressable cap of a bottle for ejecting contents of the bottle of the present invention comprises a depressable member 1, an exit tube 2 and a guiding tube 3. The depressable member 1 is fitted to a socket 4. The socket 4 is fitted to an upper end opening of the bottle 5.

Figure 3:
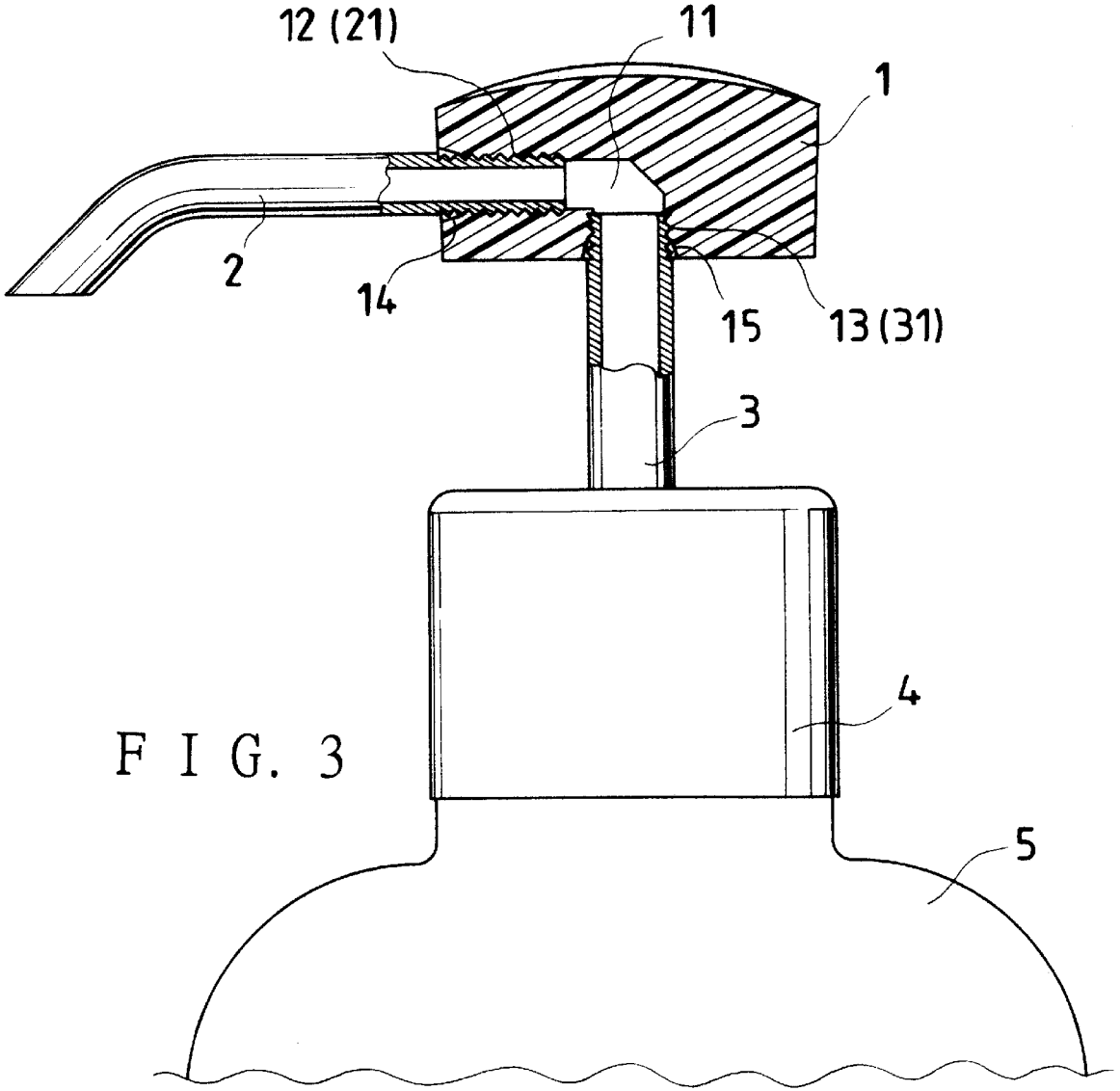
FIG. 3 is a cross-sectional view of the depressable cap of the present invention.
Figure 4:
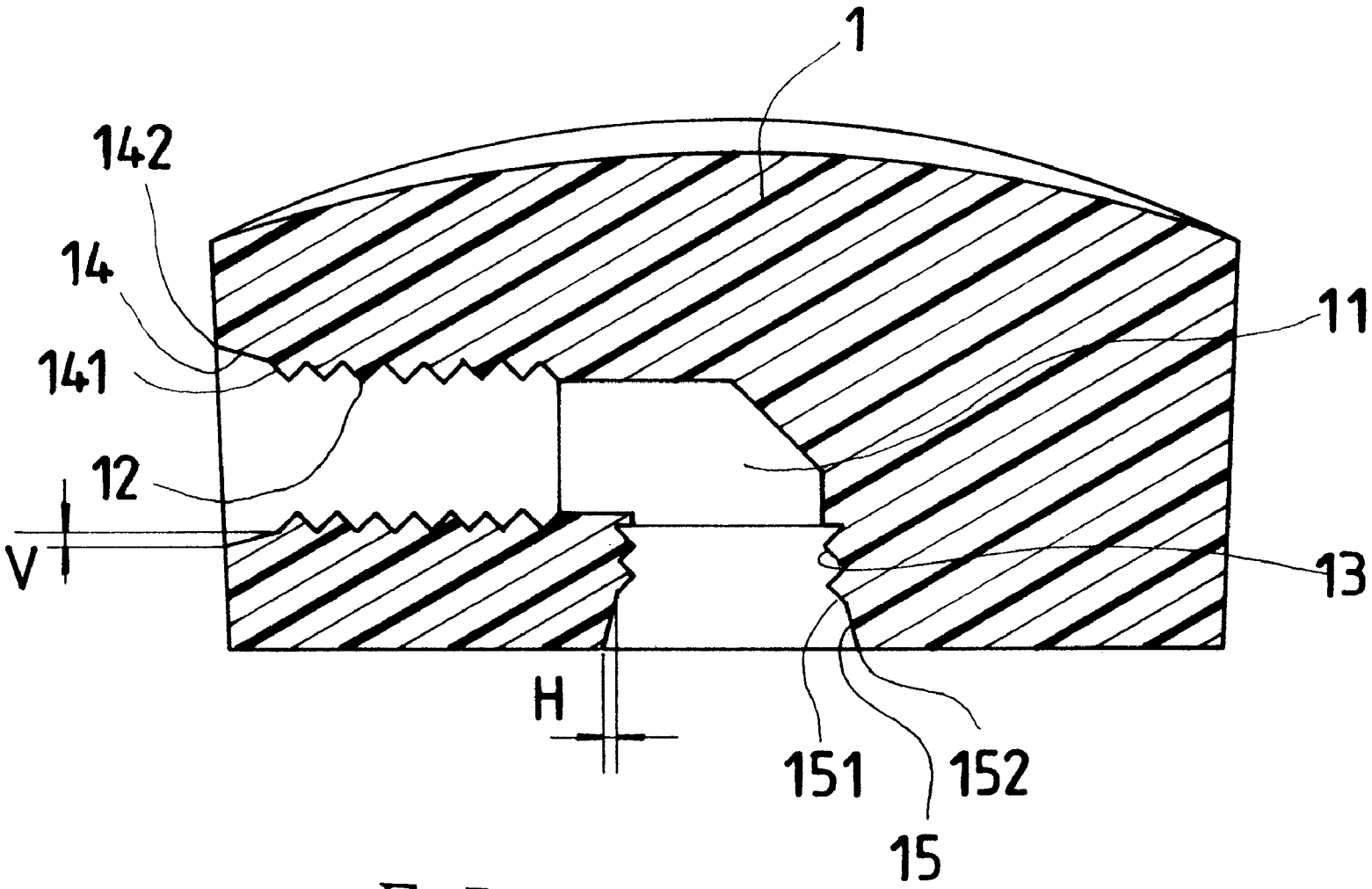
FIG. 4 is a cross-sectional view of the depressable member of the depressable cap of the present invention.

Referring to FIG. 3, the depressable member 1 has a "⌈" shaped passage 11. The passage 11 has threaded end portions 12, 13; the threaded end portion 12 is perpendicular to, and in open communication with the threaded end portion 13. Referring to FIG. 4, the threaded end portion 12 has a tapering outer end 14; the tapering outer end 14 has a front part 142 and a rear part 141 smaller than the front part 142. The width of the front part 142 is greater than that of the rear part 141 by 2V. The threaded end portion 13 has a tapering outer end 15; the tapering outer end 15 has an upper part 151 and a lower part 152. The width of the lower part 152 is greater than that of the upper part 151 by 2H. V and H each ranges from 0.02 mm to 0.2 mm.

The exit tube 2 has a threaded end portion 21. The guiding tube 3 has a threaded end portion 31.

In combination, the guiding tube 3 is screwed into the threaded end portion 13 of the depressable member 1 from the threaded end portion 31, and the exit tube 2 is screwed into the threaded end portion 14 of the depressable member 1. Alkyne adhesive is applied to joints between the threaded end portions 12 and 21 and joints between the threaded end portions 13 and 31 in order to firmly connect the exit tube 2 and the guiding tube 3 to the depressable member 1.

The depressable member 1 can be made of one of the following materials: ceramics, glass, plastics (such as PE, PP, ABS). The depressable member 1 can be processed to have various colors in order to match the bottle. The exit tube 2 and the guiding tube 3 are made of metal.

From the above description, the depressable cap of the present invention can be seen to have desirable features as follows.

1. The depressable member can be made with relatively less cost because it is made of a nonmetallic material. And, the nonmetallic depressable member can be made to have various colors member can be made to have various colors easily.

2. The exit tube and the guiding tube can be fitted to the depressable member easily and firmly because the threaded end portions are provided.

3. The manufacturers and the users of the bottle can choose a depressable member having suitable colors for the bottle in order to add value to the bottle.

What is claimed is:

1. A depressable cap of a bottle comprising:

(a) a depressable member fitted to an upper end opening of said bottle, said depressable member having a passage consisting of a first threaded end portion and a second threaded end portion, said first threaded end portion being in open communication with said second threaded end portion, said first and said second end portions each having a tapering outer end with an outermost diameter thereof greater than an innermost diameter of said tapering outer end by a dimension approximating 0.04 to 0.4 mm;

(b) an exit tube having a threaded end portion, said threaded end portion of said exit tube being screwed into said first threaded end portion of said depressable member;

(c) a guiding tube having a threaded end portion, said threaded end portion of said guiding tube being screwed into said second threaded end portion of said depressable member; and, (d) alkyne adhesive applied to respective areas between said first and second threaded end portions of said depressable member and said threaded end portions of said exit tube and said guiding tube.

* * * * *